US012650072B1

(12) United States Patent
Smith et al.

(10) Patent No.: US 12,650,072 B1
(45) Date of Patent: Jun. 9, 2026

(54) APPARATUSES AND METHODS FOR PROTECTING DRILL STRING COMPONENTS

(71) Applicants: CNPC USA CORPORATION, Houston, TX (US); BEIJING HUAMEI INC., Beijing (CN); CHINA NATIONAL PETROLEUM CORPORATION, Beijing (CN)

(72) Inventors: RC Smith, Houston, TX (US); Wade Evans, II, Katy, TX (US)

(73) Assignees: CNPC USA CORPORATION, Houston, TX (US); BEIJING HUAMEI INC., Beijing (CN); CHINA NATIONAL PETROLEUM CORPORATION, Beijing (CN)

( * ) Notice: Subject to any disclaimer, the term of this patent is extended or adjusted under 35 U.S.C. 154(b) by 0 days.

(21) Appl. No.: 19/186,980

(22) Filed: Apr. 23, 2025

(51) Int. Cl.
*E21B 47/017* (2012.01)

(52) U.S. Cl.
CPC ..... *E21B 47/017* (2020.05)

(58) Field of Classification Search
CPC ..... E21B 47/017
See application file for complete search history.

(56) References Cited

U.S. PATENT DOCUMENTS

| | | | | |
|---|---|---|---|---|
| 7,377,315 | B2 * | 5/2008 | Hall | E21B 47/12 166/66 |
| 2007/0119589 | A1 * | 5/2007 | Hall | E21B 47/01 166/242.6 |
| 2012/0096935 | A1 * | 4/2012 | Finke | E21B 17/026 73/152.03 |
| 2013/0277114 | A1 * | 10/2013 | Hook | E21B 47/017 175/50 |
| 2019/0153851 | A1 * | 5/2019 | Hered | E21B 47/017 |
| 2020/0370415 | A1 * | 11/2020 | Das | E21B 17/042 |
| 2020/0370422 | A1 * | 11/2020 | Finke | E21B 47/01 |
| 2021/0404323 | A1 * | 12/2021 | Breaux | E21B 47/013 |

* cited by examiner

*Primary Examiner* — David Carroll
(74) *Attorney, Agent, or Firm* — Frank Gao, Esq.

(57) ABSTRACT

Systems for protecting portions of a drill string and methods for manufacturing the same are disclosed. Embodiments protect measurement components, such as electronic sensors, for measuring conditions within the hole during drilling. Additional embodiments include hollow protective covers and/or sleeves that receive at least one component of a drill string and form one or more seals around a region configured to hold sensors. Some embodiments include a drill string component with one or more pockets and/or pockets into which the sensors may be positioned, and the pockets may be configured to minimize movement of the measurement components within the pockets/pockets during operation of the drill. Additional embodiments include threaded connections between the sleeve and the drill string component to assist with securing their connection, O-rings and/or receptacles for the O-rings, and/or gripping portions (including tool receptacles) to assist with applying torque when connecting the sleeve and the drill string component.

20 Claims, 1 Drawing Sheet

APPARATUSES AND METHODS FOR PROTECTING DRILL STRING COMPONENTS

FIELD

Embodiments of this disclosure relate generally to systems and methods for drilling into the Earth, and to systems and methods for protecting drill string components connected to drilling equipment.

BACKGROUND

Drilling for resources in the Earth is complex. Techniques such as Logging-While-Drilling (LWD) and Measurement-While-Drilling (MWD) have been developed to facilitate transmission of information about the drill string (including information about the drill bit) and the environment surrounding the drill string (including information surrounding the drill bit) to the surface. These techniques can be used to provide real-time information to help steer the drill. In some implementations, measurement components and/or sensors are connected to a module of the drill string.

These measurement components and/or sensors can include, for example, gyroscopes, magnetometers and accelerometers, which can provide position, directional information, borehole inclination, borehole azimuth and information about the drill bit. This information may then be transmitted to the surface through, for example, pulses in the mud column (frequently referred to as a mud pulse), wireless electronic communications (for example, electromagnetic telemetry) and wired communications.

Some implementations include connecting measurement components and/or sensors to an insert that is placed inside the hollow interior of a drill collar using a circular cutout of the drill collar and a plug to protect the electrical components, or using individual plates to cover one or more pockets that are cut into the outer surface of a drill collar and seal each individual component.

However, it was realized by the inventors of the current disclosure that problems exist with current systems for using downhole measurement components and/or sensors that are connected to the drill string during drilling and that improvements in protecting downhole measurement components and/or sensors in the harsh environment of the drill string during operation are needed. Certain preferred features of the present disclosure address these and other needs and provide other important advantages.

SUMMARY

Embodiments of the present disclosure provide an improved apparatuses and methods for protecting drill string components.

In accordance with aspects of embodiments of the present disclosure, apparatuses for protecting electronic equipment connected to a drill string configured for drilling holes into the Earth are disclosed. The apparatuses can include: a drill string component defining a cylindrical outer surface, the cylindrical outer surface including one or more drill string pockets recessed into the cylindrical outer surface of the drill string component, the one or more drill string pockets configured to accommodate/hold/embrace one or more drilling measurement components (for example, electronic components and/or sensors) positioned within the one or more drill string pockets; a protective sleeve configured to surround the drill string component, cover the one or more drill string pockets, and remain connected to the drill string component during drilling into the Earth; and/or one or more sealing members configured to prevent the passage of drilling mud and earth between the protective sleeve and the drill string component and into the one or more drill string pockets. The one or more sealing members can include one or more O-rings positioned between the protective sleeve and the drill string component. The drill string component, the protective sleeve, or the drill string component and the protective sleeve can include one or more O-ring grooves for accommodating the one or more O-rings. The drill string component and the protective sleeve can include complimentary threads for connecting the protective sleeve to the drill string component. The apparatuses can further include an abutment surface configured to stop the threaded rotation of the protective sleeve and the drill string component with respect to one another when the protective sleeve is connected to the drill string component. The drill string component can define the abutment surface. The drill string component can be a first drill string component, and a second drill string component can define the abutment surface. The protective sleeve can include one or more protective sleeve recessed portions configured to accommodate one or more drilling measurement components that are positioned within the one or more drill string pockets. The one or more drill string pockets can include at least two drill string pockets configured to receive electronic components, the apparatuses further comprising, and at least one smaller channel can connect the at least two drill string pockets, the at least one smaller channel being configured to receive electrical connectors connecting the electronic components. The protective sleeve can be a single-piece member of unitary construction.

In accordance with further aspects of embodiments of the present disclosure, methods of manufacturing a protective system for protecting electronic equipment connected to a drill string configured for drilling holes into the Earth are disclosed. The methods can include: forming one or more pockets in a drill string component, the drill string component being configured for use in drilling holes into the Earth and the one or more pockets configured to receive one or more sensors configured for use in sensing conditions of the drill string component during use; and/or forming a hollow sleeve of unitary construction, the hollow sleeve defining two open ends and a hollow portion between the two open ends, the hollow sleeve configured to receive the drill string component with the one or more pockets within the hollow portion of the hollow sleeve and to create a seal between the hollow sleeve and the drill string component, wherein the seal prevents drill mud and earth from entering the region of the drill string component that includes the one or more pockets.

The methods can include forming drill string component threads on the outer surface of the drill string component and forming sleeve threads on the inner surface of the hollow sleeve, wherein the drill string component threads and the sleeve threads are configured to engage one another and form a secure connection between the drill string component and the hollow sleeve. In some methods the forming one or more pockets can include forming one or more smaller channels in the drill string component, wherein the one or more smaller channels can be configured to receive electric connectors connecting one or more sensors that are received within the one or more pockets. Some methods can include forming one or more O-ring receptacles in the drill string component, the hollow sleeve, or the drill string component and the hollow sleeve, wherein the O-ring receptacles are configured to receive one or more O-rings.

Still additional methods can include forming an abutment surface configured for engagement with one end of the hollow sleeve and to inhibit axial movement of the hollow sleeve along the drill string component when the drill string component is received within the hollow sleeve. In some methods, forming an abutment surface includes forming an abutment surface on the drill string component. Some methods include forming gripping portions on the hollow sleeve, the gripping portions configured to enhance the ability of a user to apply torque between the hollow sleeve and the drill string component.

In still further methods, the forming of gripping portions includes forming tool receptacles configured to engage with a torqueing tool.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. E ach embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
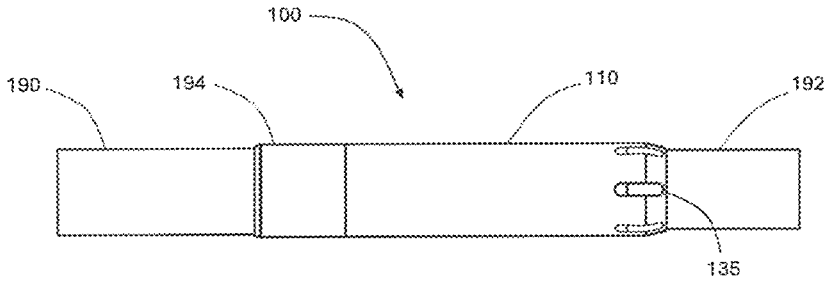
FIG. 1 is a side view of a drill string component protection system according to at least one embodiment of the present disclosure.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" that may occur within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Embodiments of the present disclosure provide a drill string component protection system that protects measurement components (for example, electronic equipment and/or sensors) attached to a drill string during drilling.

Embodiments include systems and methods that allow measurement components (for example, electronics) to be directly mounted to a component of the drill string. For example, in some embodiments electronic components are mounted to a drill collar, which is typically a heavy cylindrical component of the drill string that is located near the drill bit to provide weight and stability to the drill bit. These electronic components may be part of a measurement tool or perform some other function, such as sensing characteristics of the drill string and/or the surrounding environment. In some embodiments, electronic components that are connected to the drill pipe are sealed with a protective sleeve that creates a protected cavity for the electronics and shields the electronics from harmful drilling conditions.

Embodiments of the present disclosure provide a protective assembly for components (for example, electrical components) connected to portions of a drill string, and some embodiments provide a protective assembly that is easy to assemble and maintain.

Embodiments of the present disclosure seal off one or more electronics cavities.

In at least one embodiment, a protective sleeve is positioned over one or more portions of the drill string, for example, pockets and/or cavities in the outer surface of a drill collar that are configured to hold components, such as electrical boards, wires and/or transducers.

Embodiments include a single sleeve that surrounds and protects all components at once for sealing the sleeve to the outer surface of the drill.

Some embodiments include a cylindrical protective sleeve that is sealed at both ends for the O-rings and smooth sealing surfaces.

Additional embodiments include sealing surfaces for O-rings that are separated by the grooves and features that hold the sensitive electronics in place.

Figure 2:
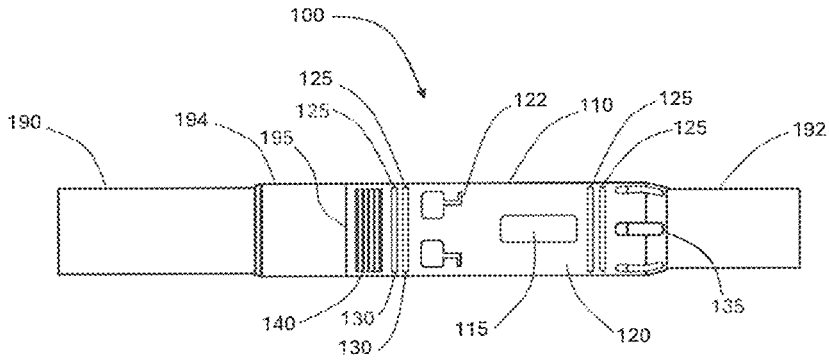
FIG. 2 is a side view of the drill string component protection system depicted in FIG. 1 with the outer cover.

FIGS. 1-2 depict a drill string component protection system 100 according to one or more embodiments of the present disclosure. System 100 includes an outer cover (for example, a sleeve 110) that surrounds a portion of the drill string 190. In the example shown in FIGS. 1-2, a sleeve 110 is used as an example outer cover and a drill collar 192 is used as an example portion of the drill string. System 100 further includes one or more grooves 120 (which may be referred to as pockets), which are included in the outer surface of the portion of the drill string 190 surrounded by the sleeve 110 (in the illustrated example, in the outer surface of the drill collar 192) and/or are included in the inner surface of the outer cover.

The outer cover (sleeve 110) may be a single-piece member of unitary construction (such as a solid piece of metal that is machined to form the hollow cylinder or a single-piece hollow cylinder formed through additive manufacturing), or in some embodiments may be a multi-piece member (for example, two semi-circular halves of a hollow cylinder that engage and longitudinally slide against one another and engage and form a single hollow cylinder). Although depicted as having a circular outer surface, additional embodiments of sleeve 110 have outer surfaces of different shapes, such cylindrical geometric shapes (for example, pentagons, hexagons and octagons).

Pockets 120 form one or more locations where measurement components (for example, electronic components 115) may be located. The electronic components 115, for example, that are positioned within the one or more pockets 120 may be recessed below the adjacent surface of the component where the pockets are located (for example, drill collar 195). In some embodiments the electronic components 115, for example, may be flush with the adjacent surface of the drill collar 192, for example. Optional channels 122 forming differently sized (for example, smaller) recesses in the outer surface of the example drill collar 192 may be included to provide locations where measurement components (or components of measurement) of different sizes (for example, electrical connectors between the larger electronic components) may be received.

An optional feature of the one or more pockets 120 and/or the one or more channels 122 is that they may be configured to snugly receive the measurement components being positioned therein. Advantages of these embodiments include reducing movement of the measurement components within the one or more pockets 120 and/or the one or more channels 122 (for example, reduce rattling) while the drill string 190 is in use. In some embodiments the snug fit of the one or more measurement components into the one or more pockets 120 and/or channels 122 may include a friction fit, an interference fit, or a click fit (for example, one or more of the side surfaces of the pockets 120 and/or channels 122 may be chamfered. Although some embodiment use a press fit, care should be used since the forces required for a press fit can damage sensitive measurement components (such as electronic components 115) and/or the drill collar 192.

Some embodiments include complimentary threaded surfaces on the sleeve 110 and the drill collar 192 to maintain the connection between the sleeve 110 and the drill collar 192. For example, FIG. 2 depicts threads 140 on the left side of the illustrated sleeve 110 and drill collar 192 that engage with one another and facilitate a firm connection between the sleeve 110 and the drill collar 192. When connecting the sleeve 110 to the drill collar 192, the sleeve 110 may be slipped over a portion of the drill collar 192 (slipped over the right side of the drill collar 192 in FIG. 2) and moved along the drill collar 192 until the threads begin to engage. The sleeve 110 may then be rotated to engage the threads. The sleeve 110 may also include gripping portions (for example, the tool receptacles 135 illustrated in FIGS. 1-2) to enhance the ability of a user to provide torque to rotate the sleeve 110 with respect to the drill collar 192. In at least some embodiments the thread direction is chosen so that friction between the sleeve 110 and the exterior earth and/or drilling mud further tightens the sleeve 110 onto the drill collar 192 and thereby inhibits loosening of the sleeve 110 during use.

In some embodiments, sealing members enhance the sealing of electronic components 115 from the environment outside the system 100. In some embodiments, the threads 140 are the sealing members to seal the electronic components 115 from the outside environment. However, other embodiments include sealing members in addition to the threads 140 to seal the electronic components 115 from the outside environment. Even if the threads on the sleeve do provide a seal, O-rings at the lower end of the sleeve are needed to create a seal. For example, some embodiments include O-rings 125 as sealing members. Additional pockets 130 to accommodate the one or more O-rings 125 may also be included in the drill collar 192 and/or the sleeve 110 to assist with positioning the one or more O-rings 125.

Embodiments of system 100 may also include features that assist with proper positioning of sleeve 110 on drill collar 192. For example, an abutment surface 195 may be included to stop the rotation of sleeve 110 in the appropriate location during installation of sleeve 110 on drill collar 192. In some embodiments, the abutment surface 195 is integrated with the drill collar 192 (drill string component), while in other embodiments the abutment surface may be part of a separate member, such as a connected drill string subassembly 194. Gripping portions (for example, tool receptacles 135) may also be included on the component that includes the abutment surface 195 to facilitate applying torque to connection between sleeve 110 and drill collar 192 and creating a secure connection between the sleeve 110 and the drill collar 192.

In use, the electronic components 115 (measurement components) are placed into the pockets 120 and/or channels 122 where the electronic components 115 may be snugly embraced by the pockets 120 (and optionally the channels 122). One end of the drill collar 192 (drill string component) is inserted into the sleeve 110. In FIGS. 1 and 2, the right end of the drill collar 192 is inserted into the left end of the sleeve 110. The sleeve 110 is then slid over the drill collar 192 until the threads 140 on the sleeve 110 and the drill collar 192 contact one another. The sleeve 110 and the drill collar 192 are then rotated with respect to one another to engage the threads 140.

One or more optional O-rings 125 positioned between the sleeve 110 and the drill collar 192, such as by be being positioned in one or more O-ring pockets 130 in the drill collar 192, will engage the sleeve 110. Additional torque may need to be applied once the one or more O-rings 125 are squeezed between the sleeve 110 and the drill collar 192. At any time during installation, additional torque can be applied using the gripping portions (torque enhancing features), such as by engaging the tool receptacles (for example, tool receptacles 135) with torqueing tools.

When the end of the sleeve 110 adjacent the threads 140 contacts the abutment surface 195, additional torque may be applied to the sleeve 110 and the drill collar 192 to create a firm connection between the sleeve 110 and the drill collar 192. Again, one or more torqueing tools engaging the one or more tool receptacles 135 may be used to add the additional torque. During drilling, forces exerted onto the sleeve 110 by the external environment are in a direction that will further tighten the sleeve 110 onto the drill collar 192.

Reference systems that may be used herein can refer generally to various directions (e.g., upper, lower, forward and rearward), which are merely offered to assist the reader in understanding the various embodiments of the disclosure and are not to be interpreted as limiting.

To clarify the use of and to hereby provide notice to the public, the phrases "at least one of A, B, . . . and N" or "at least one of A, B, . . . N, or combinations thereof" or "A, B, . . . and/or N" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. As one example, "A, B and/or C" indicates that all of the following are contemplated: "A alone," "B alone," "C alone," "A and B together," "A and C together," "B and C together," and "A, B and C together." If the order of the items matters, then the term "and/or" combines items that can be taken separately or together in any order. For example, "A, B and/or C" indicates that all of the following are contemplated: "A alone," "B alone," "C alone," "A and B together," "B and A together," "A and C together," "C and A together," "B and C together," "C and B together," "A, B and C together," "A, C and B together," "B, A and C together," "B, C and A together," "C, A and B together," and "C, B and A together."

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used or applied in combination with some or all of the features of other embodiments unless otherwise indicated. One or more exemplary embodiments have been shown and described, and all changes and modifications that come within the spirit of the disclosure are desired to be protected.

ELEMENT NUMBERING

Table 1 includes element numbers and at least one word used to describe the element and/or feature represented by the element number. However, none of the embodiments disclosed herein are limited to these descriptions. Other words may be used in the description or claims to describe a similar member and/or feature, and these element numbers can be described by other words that would be understood by a person of ordinary skill reading and reviewing this disclosure in its entirety.

TABLE 1

| | |
|---|---|
| 100 | drill string component protection system |
| 110 | sleeve |
| 115 | measurement components (electronic components) |
| 120 | pocket |
| 122 | channels |
| 125 | O-rings |
| 130 | o-ring grooves |
| 135 | receptacles |
| 140 | threads |
| 190 | drill string |
| 192 | drill collar |
| 194 | subassembly |
| 195 | abutment surface |

What is claimed is:

1. An apparatus for protecting electronic equipment connected to a drill string configured for drilling holes into the Earth, comprising:

a drill string component defining a cylindrical outer surface, the cylindrical outer surface including one or more drill string pockets recessed into the cylindrical outer surface of the drill string component, the one or more drill string pockets configured to accommodate/hold/embrace one or more drilling measurement components positioned within the one or more drill string pockets;

a protective sleeve configured to surround the drill string component, cover the one or more drill string pockets, and remain connected to the drill string component during drilling into the Earth;

a drill string subassembly; and one or more sealing members configured to prevent the passage of drilling mud and earth between the protective sleeve and the drill string component and into the one or more drill string pockets.

2. The apparatus of claim 1, wherein the one or more sealing members include one or more O-rings positioned between the protective sleeve and the drill string component.

3. The apparatus of claim 2, wherein the drill string component, the protective sleeve, or the drill string component and the protective sleeve include one or more O-ring pockets for accommodating the one or more O-rings.

4. The apparatus of claim 1, wherein the drill string component and the protective sleeve include complimentary threads for connecting the protective sleeve to the drill string component.

5. The apparatus of claim 4, further comprising:

an abutment surface configured to stop the threaded rotation of the protective sleeve and the drill string component with respect to one another when the protective sleeve is connected to the drill string component.

6. The apparatus of claim 5, wherein the drill string component defines the abutment surface.

7. The apparatus of claim 5, wherein the drill string component comprises a first drill string component.

8. The apparatus of claim 7, further comprises a second drill string component defines the abutment surface.

9. The apparatus of claim 1, wherein the one or more drill string pockets include at least two drill string pockets configured to receive electronic components, the apparatus further comprising:

at least one channel connecting the at least two drill string pockets, the at least one channel configured to receive electrical connectors connecting the electronic components.

10. The apparatus of claim 1, wherein the protective sleeve is a single-piece member of unitary construction.

11. The apparatus of claim 1, wherein the protective sleeve is a single-piece member of unitary construction, the drill string component and the protective sleeve include complimentary threads for connecting the protective sleeve to the drill string component, the one or more sealing members include one or more O-rings positioned between the protective sleeve and the drill string component, the drill string component includes one or more O-ring pockets for accommodating the one or more O-rings, and the one or more drill string pockets include at least two drill string pockets configured to receive electronic components, the apparatus further comprising:

at least one channel connecting the at least two drill string pockets, the at least one channel configured to receive electrical connectors connecting the electronic components.

12. A method of manufacturing a protective system for protecting electronic equipment connected to a drill string configured for drilling holes into the Earth, the method comprising:

forming a hollow sleeve of unitary construction, the hollow sleeve defining two open ends and a hollow portion between the two open ends, the hollow sleeve configured to receive a drill string component with the one or more measurement components within the hollow portion of the hollow sleeve and to create a seal between the hollow sleeve and the drill string component, wherein the seal prevents drill mud and earth from entering the region of the drill string component that includes the one or more measurement components;

forming a drill string subassembly; and forming one or more channels in the drill string component.

13. The method of claim 12, further comprising:

forming one or more grooves in the drill string component, the drill string component being configured for use in drilling holes into the Earth and the one or more grooves configured to receive one or more sensors configured for use in sensing conditions of the drill string component during use.

14. The method of claim 12, wherein the one or more channels are configured to receive electric connectors connecting one or more measurement components that are received within the one or more pockets.

15. The method of claim 12, further comprising:

forming one or more O-ring receptacles in the drill string component, the hollow sleeve, or the drill string component and the hollow sleeve, wherein the O-ring receptacles are configured to receive one or more O-rings.

16. The method of claim 12, further comprising:

forming an abutment surface configured for engagement with one end of the hollow sleeve and to inhibit axial movement of the hollow sleeve along the drill string component when the drill string component is received within the hollow sleeve.

17. The method of claim 16, wherein the forming an abutment surface includes forming an abutment surface on the drill string component.

18. The method of claim 12, further comprising:

forming portions on the hollow sleeve, the gripping portions configured to to apply torque by a user between the hollow sleeve and the drill string component when the drill is received within the hollow portion of the hollow sleeve.

19. The method of claim 18, wherein the forming gripping portions comprises forming tool receptacles configured to engage with a torquing tool.

20. The method of claim 12, further comprising:

forming drill string component threads on the outer surface of the drill string component;

forming sleeve threads on the inner surface of the hollow sleeve;

forming one or more O-ring receptacles in the drill string component, the hollow sleeve, or the drill string component and the hollow sleeve, wherein the O-ring receptacles are configured to receive one or more O-rings;

forming an abutment surface configured for engagement with one end of the hollow sleeve and to inhibit axial movement of the hollow sleeve along the drill string component when the drill string component is received within the hollow sleeve; and forming tool receptacles on the hollow sleeve, the tool receptacles configured to engage with a torqueing tool to enhance the ability of a user to apply torque between the hollow sleeve and the drill string component when the drill is received within the hollow portion of the hollow sleeve;

wherein the drill string component threads and the sleeve threads are configured to engage one another and form a secure connection between the drill string component and the hollow sleeve, and wherein forming one or more pockets includes forming one or more channels in the drill string component, wherein the one or more smaller channels are configured to receive electric connectors connecting one or more sensors that are received within the one or more pockets.

* * * * *